United States Patent [19]

Grubenmann

[11] 3,970,984

[45] July 20, 1976

[54] SWITCH HAVING HEMISPHERICAL PIVOTAL COVER ACTUATOR FOR MOVABLE LEVER CONTACT MEMBER

[75] Inventor: Manfred Grubenmann, Steckborn, Switzerland

[73] Assignee: Fritz Gegauf Aktiengesellschaft, Bernina-Nahmaschinenfabrik, Switzerland

[22] Filed: Dec. 16, 1974

[21] Appl. No.: 533,210

[30] Foreign Application Priority Data

Jan. 10, 1974 Switzerland ..... 274/74

[52] U.S. Cl. ..... 338/153; 200/86.5; 200/153 C; 338/65

[51] Int. Cl.[2] ..... H01C 10/30; H01H 3/14

[58] Field of Search..... 200/6 R, 6 A, 6 B, 6 BA, 200/86.5, 153 C, 329, 336, 339; 338/47, 108, 152, 153, 155, 160, 162–165, 167, 169, 184, 199, 202, 215

[56] References Cited

UNITED STATES PATENTS

| | | | |
|---|---|---|---|
| 1,992,929 | 2/1935 | Fator | 200/86.5 X |
| 2,333,814 | 11/1943 | Perkins | 338/108 |
| 2,424,529 | 7/1947 | Wimmer | 20/86.5 X |
| 2,925,573 | 2/1960 | Brown et al. | 338/47 |
| 2,981,915 | 4/1961 | Sonstegard | 200/86.5 X |
| 2,988,720 | 6/1961 | Voorlas | 338/108 |
| 3,118,123 | 1/1964 | Sweet et al. | 200/86.5 X |
| 3,401,240 | 9/1968 | Groves | 200/6 BA |
| 3,639,877 | 2/1972 | Fresard et al. | 338/153 |

*Primary Examiner*—James R. Scott
*Attorney, Agent, or Firm*—McGlew and Tuttle

[57] ABSTRACT

A switch construction, comprises a support base upon which is mounted a spring of hemispherical outline which includes an annular lower portion with a plurality of upstanding circumferentially spaced curved segment portions which are spaced apart at their tops to define a centering area for a top cover which is pivotal on the base. A contact member is in the form of a lever which is pivoted at one end on an upstanding portion of the base, and has an opposite engagement end which, for example, is movable along a rheostat control for the purpose of changing the setting thereof. The switch contact member is provided with a central substantially hemispherical cam portion which cooperates with a foot actuated cover and a similar cam portion defined on the cover which is located within the central part of the supporting spring.

8 Claims, 6 Drawing Figures

SWITCH HAVING HEMISPHERICAL PIVOTAL COVER ACTUATOR FOR MOVABLE LEVER CONTACT MEMBER

FIELD AND BACKGROUND OF THE INVENTION

This invention relates in general to the construction of switches and, in particular, to a new and useful switch which includes a universally mounted cover which is suited for foot actuation and which is supported on a spring member so that any movement thereof will be transmitted to a pivotal contact member which is displaced by the movement of the cover to provide an electrical actuation.

DESCRIPTION OF THE PRIOR ART

The present invention is particularly directed to a foot actuated switch in which the cover of the switch housing forms a foot pedal which is pivotally connected or hinged to the housing accommodating the switch or control means. With such a design, all of the switching or control devices have the considerable disadvantage that they must be permanently held by the operator in a certain working position. However, since in the majority of cases, the switching or control device is located outside of the operator's range of vision on the floor under the working table, it is frequently unintentionally displaced from its working position and can no longer be actuated properly.

Attempts to overcome this disadvantage have been made, in which a control device includes a cylindrical housing which contains the control means and a slightly conical cover which serves as a foot switch, which is pivotal relative to the housing through a certain angle about a vertical axis for actuating the control means mounted within the housing. Such a control device has the great disadvantage that for actuation, the operator must execute unnatural movements which may be soon and ultimately leads to fatigue of the foot. In addition, there is a risk that, on a smooth base, the housing will turn along the cover to thereby reduce or even prevent the intended control.

SUMMARY OF THE INVENTION

In accordance with the present invention, there is provided a foot-actuated switching or control device which avoids the drawbacks of the known constructions. The switching or control device can be actuated by natural movements of the foot independently of a certain working position and without affecting the operating of the control means located in the housing. This is obtained, in accordance with the invention, by providing that both by exerting a vertical pressure on the cover from above, and by tilting it in any direction relative to the stationary housing, the cover can be brought from a substantially horizontal rest position in which the built-in switching or control means are ineffective or neutral, to a working position, in which the switching or control means are effective independently of the direction in which the cover is moved.

The invention provides a switch which includes a base which supports a contact actuating member and which is provided with a cover which is universally pivotally supported on a resilient, generally hemispherical spring. The generally hemispherical spring is made up of a plurality of circumferentially spaced arcuate spring portions which extend upwardly from an annular base part supported on the support base. The cover is provided with an inwardly extending hemispherical central portion which rests within the top ends of the upwardly curved spring side parts and it cooperates with a similar hemispherical surface of the contact lever member so that movement of the cover in any direction including axial and pivotal directions will cause a displacement of the lever actuator member to affect a control movement. The lever control member is advantageously biased into a neutral position in which it is located substantially horizontally by a spring.

Accordingly, it is an object of the invention to provide an improved switch construction wherein a cover is universally mounted over a switch actuator or contact member and supported on a generally hemispherically shaped spring which permits movement of the cover in an axial direction as well as the pivotal movement thereof and camming surfaces defined between the cover and the contact actuator permit movement of the actuator with movement of the cover in any direction.

A further object of the invention is to provide a switch construction, particularly a foot-actuated switch, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
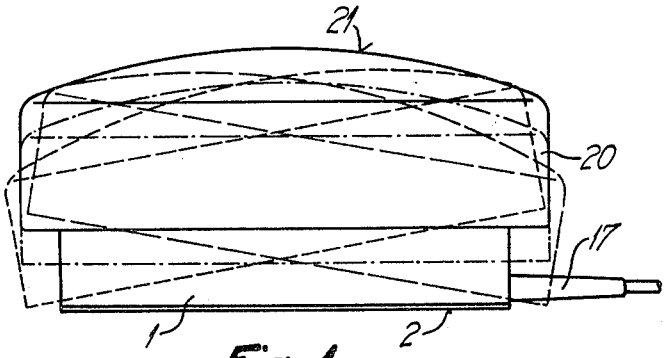
FIG. 1 is a side elevational view of a switch constructed in accordance with the invention.

Referring to the drawings in particular, the invention embodied therein, comprises a switch having a base portion or support base 1, which forms an open-topped housing bottom which is closed on the top by a top portion or cover 20. Base 1 is provided with a bottom which has a non-skid covering 2 thereon. The support base 1 includes an annular sidewall 3 which is preferably cylindrical or polygonal and it is provided with at least three circumferentially spaced radially outwardly projecting guide ribs 4 which, in the embodiment shown, are at equally spaced locations around the upper circumference of the sidewall 3.

Figure 2:
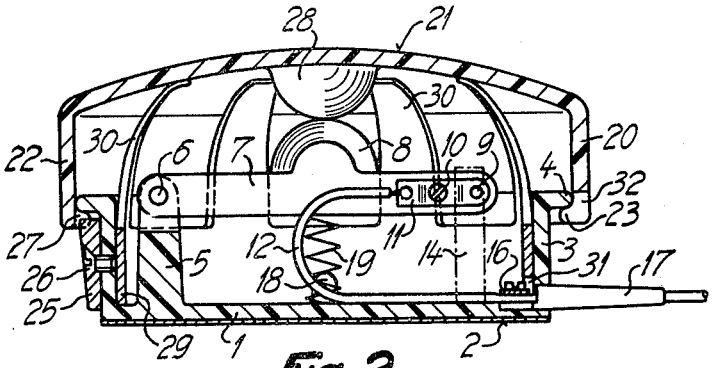
FIG. 2 is a longitudinal sectional view of the switch shown in FIG. 1.
Figure 3:
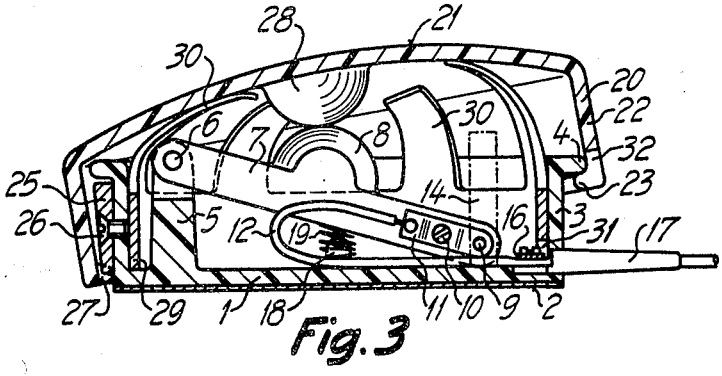
FIG. 3 is a view similar to FIG. 2 showing the switch in an actuated position.
Figure 4:
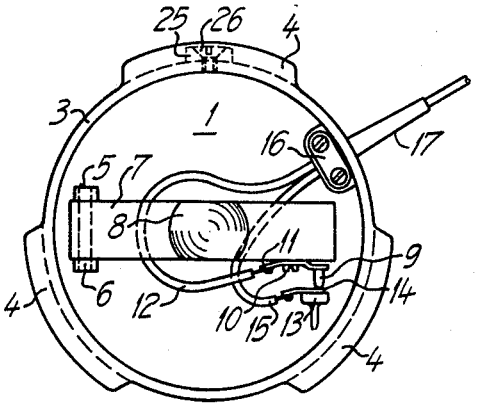
FIG. 4 is a top plan view of the base portion of the switch.
Figure 5:
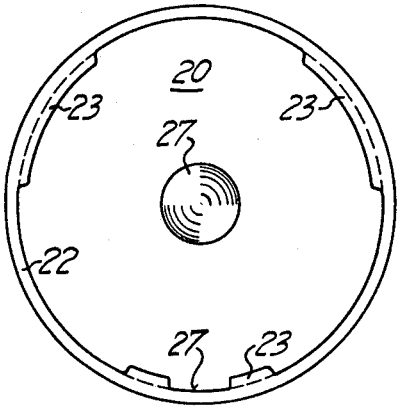
FIG. 5 is a bottom plan view of the cover of the switch.
Figure 6:
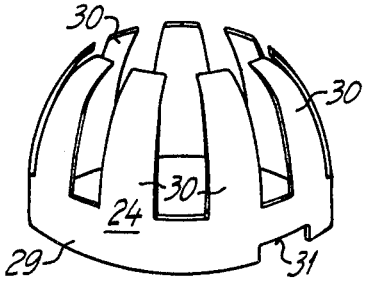
FIG. 6 is a perspective view of the supporting spring for the cover.

The base 1 is provided with an upstanding support or bracket 5 which is made integral with the base and which supports one end of a control lever actuator or contact member 7 which is mounted for pivotal movement on the bracket 5 in a vertical plane about the pivot axis 6. Contact member 7 and top cover 20 have cam means defined therebetween which, in the embodiment shown, comprises a hemispherical cam 8 on the contact member 7 which engages with a hemispherical cam 28 on the interior of the cover 20. Contact member 7 is also provided with a contact pin 9. Pin 9 is connected to control lever 7 by means of a connecting lug 11 which is secured by means of a screw or rivet 10. The connecting lug is advantageously made of an elastic material so that within certain limits, contact pin 9 can spring. An electrical lead 12 is connected to lug 11. Fixed contact means which in the embodiment shown comprises a potentiometer or variable resistance element 14 is mounted on a holder 13 integral with housing 1 and it is connected to an electric lead 15. The variable resistance element 14, which is indicated in FIGS. 2 and 3 in dash-dotted lines, is positioned so that the springy contact pin 9 will slide along the potentiometer when contact member 7 is moved. The two electric leads 12 and 15 extend through housing base 1 and a traction relief member 16 and a socket 17 are connected to an electric motor (not shown) whose speed is to be controlled by means of the switching or control device, for example.

Biasing means are provided to bias contact member 7 to a neutral position and these include a central pin 18 formed on housing base 1 over which a helical spring 19 is positioned and which bears at its outer end against control lever 7 to urge it into the neutral or rest position shown in FIG. 2. In the neutral or rest position, the contact pin 9 engages on a non-conductive portion of the variable resistance element 14 so that the electrical circuit through leads 12 and 15 is interrupted.

In accordance with a feature of the invention, cover 20 forms a foot actuator which is provided with a slightly conical or convex surface 21, and is universally supported on spring means or a spring support 24. Cover 20 is of generally cylindrical shape and conforms to the shape of the housing base 1 so that a completely closed receptacle for the control means is formed. The border of the cylindrical or polygonal lateral wall 22 of cover 20 is formed with a plurality of radially inwardly projecting guide ribs 23 which correspond in number to the guide ribs 4 provided on the housing base 1. The height of the circular guide ribs 4 of housing 1 is slightly smaller than half of the difference between the outer diameter of the housing and the inner diameter of the cover 20. The guide ribs 23 on cover 20 are only so high as to insure a reliable anchoring of the guide ribs 4 of housing 1. The arc length of the guide ribs 23 on cover 20 is shorter than the arc length between two guide ribs 4 of housing 1. This design of guide ribs 4 and 23 permits a bayonet-type fitting between the housing 1 and the cover 20. At the same time, cover 20 may be displaced in an axial as well as a pivotal direction on its associated spring support 24. In order to prevent an unintentional disengagement of the housing and cover 20, a locking piece 25 is provided which is fixed to the housing base 1 by means of a screw 26 and cooperates with a recess 27 in one of the guide ribs 23 of the cover so that cover 20 is freely displaceable in the axial direction but secured against rotational movement.

The interior wall of the cover 20 is provided with a hemispherical projection 28 which forms part of the cam means which cooperates with the other cam means part, the hemispherical projection 8 of contact member 7. The cam means are located centrally of the cover within recesses defined centrally of upstanding curved arm portions 30 of the spring 24 which includes an annular base 29 which support the arm portions. Base 29 is notched at 31 to provide access for entrance of the connecting wires. The cam means support cover 20 so that it can move both axially and pivotally in all directions to pivot contact member 7 about its pivot 6 to move it out of its neutral position, which is shown in FIG. 2, to an actuated position located between the position shown in FIG. 2 up to the end position shown in FIG. 3. By such an arrangement, the potentiometer 14 may be used to control the speed of an electromotor, for example.

A recess 32 is provided in cover 20 at the location where the socket 17 extends through the housing 1 in order to ensure that there will be no hindering of the motion of the cover. Cover 20 serves as a foot pedal of the switching or control device and it is normally retained in the rest position shown in FIG. 2 by the action of spring 24 in the spring 19 which returns the contact lever 7 to a neutral position.

The spring support means 24 has a bottom portion 29 with an outer diameter which is somewhat smaller than the inner diameter of the housing base 1 so that the support base 29 may be centered and retained thereon. The recess 31 in addition to its function as a passageway for the electrical connections also provides the means for the angular locking of the spring support 24 on base 1. Spring arms 30 extend upwardly from the base at 29 to form the surface of a rotational hemisphere. The contact member 7 is being shown as a member which may be either in a neutral position or any one of many actuating positions, and this may serve as a device for actuating a potentiometer or any other type of control circuit.

While a specific embodiment of the invention has been shown and described in detail to illustrate the application of the principles of the invention, it will be understood that the invention may be embodied otherwise without departing from such principles.

What is claimed is:

1. A switch construction, comprising a fixed support base, a spring having an upstanding generally hemispherically arranged resilient wall means mounted on said base, a cover actuator member overlying said resilient wall means and universally pivotally supported thereon, a lever contact member having one end pivotally supported on said support base and having an opposite movable and insulatively supported or electrically conductive contact end, cam means between said cover actuator and said lever contact permitting orientation of said lever contact in a neutral position and effecting pivotal movement of said lever to an actuating position upon pivotal and axial displacement of said cover member, electrically conductive fixed contact means on said support base alongside said lever contact member and operatively engageable therewith in an actuating position, and means biasing said lever contact member to a neutral position.

2. A switch construction, according to claim 1, wherein said base includes a lower substantially cylindrical housing portion, said cover comprising an upper substantially cylindrical top portion and forming a foot pedal.

3. A switch construction, according to claim 1, wherein said base portion and said cover are of substantially cylindrical configuration, each having interengaged portions with spaced circumferentially extending rib formations which interfit in the manner of a bayonet-type joint.

4. A switch construction, according to claim 1, wherein said spring comprises a spring member having an annular base with a plurality of upstanding hemispherically curved wall portions, each wall portion terminating in tops which are spaced apart to leave a central opening, said cam means comprising a hemispherical portion on said cover engaged with a hemispherical portion on said lever contact member.

5. A switch construction, according to claim 4, wherein said spring is made of plastic material.

6. A switch construction, according to claim 1, including an upstanding bracket on said base, said lever contact member having one end pivoted at the upper end of said upstanding member on said base, said fixed contact means comprising a variable resistance element located adjacent the opposite end of said lever contact member, said lever contact member having a contact tip engageable with said variable resistance element and being movable therealong, said means biasing said lever contact member comprising a coil spring mounted on said base and extending upwardly into contacting engagement with said lever contact member.

7. A foot control operated rheostat, comprising the fixed support base, a spring member having an annular base for the plurality of upstanding hemispherical curved wall portions, each wall portion terminating in tops which are spaced apart to leave a central opening, a generally hemispherically formed cover foot actuator member overlying said spring and having a hemispherical portion centered within the tops of said spring, the lever contact member having one end pivotally supported on said support base and having an opposite movable contact end, electrically conductive contact insulatably supported on said lever member contact end, said lever member having an intermediate portion with a hemispherical part cooperatively engaged with the hemispherical portion of said cover and cooperating with said spring to provide a universal support for said cover, an upstanding fixed contact member arranged alongside said movable contact end and engageable with said electrically conductive contact, spring means urging said lever member to an inoperative position, said lever member being movable by depression of said cover member to advance said movable contact along said fixed contact.

8. A switch construction according to claim 7, wherein said fixed contact comprises a variable resistance element, said movable contact being advanceable along said element for changing the setting thereof.

* * * * *